US006119275A

United States Patent [19]

Goyal

[11] Patent Number: 6,119,275

[45] Date of Patent: Sep. 19, 2000

[54] BACK INSULATING UNDERGARMENT

[76] Inventor: Kanu Shri Goyal, 228 Whispering Hills Rd., Naperville, Ill. 60540

[21] Appl. No.: 09/123,926

[22] Filed: Jul. 27, 1998

[51] Int. Cl.[7] ..... A41B 9/00

[52] U.S. Cl. ..... 2/400; 2/44; 2/403; 2/228

[58] Field of Search ..... 2/44, 45, 92, 400, 2/403, 228, 227, 238, 455, 456, 467, 69, 404, 407, 267; 128/96.1, 99.1, 100.1, 101.1; 602/70–72

[56] References Cited

U.S. PATENT DOCUMENTS

| | | | |
|---|---|---|---|
| 4,156,294 | 5/1979 | Hora | 2/400 |
| 4,425,667 | 1/1984 | Harrison | 2/2 |
| 4,462,115 | 7/1984 | Carison et al. | 2/406 |
| 4,627,109 | 12/1986 | Carabelli et al. | 2/44 |
| 4,660,554 | 4/1987 | Wright | 128/158 |
| 4,700,407 | 10/1987 | Mattila | 2/23 |
| 4,807,301 | 2/1989 | Ferber | 2/267 |
| 4,969,216 | 11/1990 | Guelli | 2/400 |
| 5,140,721 | 8/1992 | Kauffeld | 2/2 |
| 5,365,610 | 11/1994 | Lubahn et al. | 2/23 |
| 5,398,667 | 3/1995 | Witt | 2/44 |
| 5,471,680 | 12/1995 | Vesternen | 2/44 |
| 5,551,091 | 9/1996 | Tyndall | 2/227 |
| 5,636,377 | 6/1997 | Wiener | 2/465 |
| 5,649,328 | 7/1997 | Martin | 2/238 |
| 5,749,101 | 5/1998 | Breindel | 2/403 |

*Primary Examiner*—Gloria M. Hale
*Assistant Examiner*—Tejash Patel

[57] ABSTRACT

An underwear garment structured so that it will alleviate pain of those people who have lower back problems, by sewing a pocket for securing a pad to the rear of the underwear to provide the lower back of the wearer with extra warmth by insulating the body and by providing extra insulation to retain heat in the body.

8 Claims, 4 Drawing Sheets

BACK INSULATING UNDERGARMENT

FIELD OF INVENTION

This invention relates to undergarments. Specifically, this invention relates to supportive undergarments that insulates and thus decreases the pain in the lower back of the wearer.

BACKGROUND OF INVENTION

This invention concerns clothing undergarments especially those that provide pads for comfort, safety, and disease prevention.

Most often, people who experience lower back pains do not have a treatment that endures for the entire day, and thus, they go on through the day in pain and uncomfortableness.

Currently, there are many ways to help alleviate such a problem. The person can take ibuprofen or aspirin to kill the pain. But, as most medicines have, these have side effects. The person could also use balm or a heating pad to relieve the pain. However, all of these can be cumbersome and do not always provide comfort. Therefore, there exists a need for an invention that will alleviate lower back pains, but without causing any discomfort to the person. This invention is specifically designed for this purpose.

Prior to this, there have been some undergarments with cushion therein, but none like the present invention. For instance, U.S. Pat. No. 4,156,294 by Horn (1979) shows an undergarment that protects the hips and buttocks, specifically those of baseball players. U.S. Pat. No. 5,636,377 by Wiener (1995) shows an undergarment with rigid "shields" that absorb some of the impact when an elderly person falls. Similar to this last one, U.S. Pat. No. 4,807,301 by Ferder (1989) provides protection to the hips against the normal stress of falling, except it has pockets, into which the protective pads are put. Then there is U.S. Pat. No. 5,140,721, which deals with a thermally protective diving undergarment made with plastic bubble packing sheets. Other relevant prior inventions includes U.S. Pat. No. 4,462,115 by Carlson, et al., (1984), which is also a shock-absorbing undergarmnent; U.S. Pat. No. 4,700,407 by Mattila (1987), which like the previous provides shock-absorbing pads; and, U.S. Pat. No. 4,969,216 by Alphonse (1990), which provides cushion for sitting for long periods of time. Most of these prior involved some form of padded underwear, primarily for protecting a person from a stumble. However, none provide padding for the purpose of insulation of the lower back.

SUMMARY OF THE INVENTION

The primary objective of this invention is to provide an undergarment that alleviates lower back pains.

Another objective of this invention is to provide an underwear garment such that it can be worn properly on the human body, and still not be noticeable through outer garments.

Another objective is to provide an underwear garment that is easy to wear and comfortable.

This innovative undergarment contains an insulator located on the upper back part of the underwear briefs or boxer or the lower back part of the undershirt. The choice of materials depends on its comfortability and its efficacy in insulation. Also, this pad is attached to the underwear or undershirt such that it spans the area of the wearer's lower back. The pad may be extended to the sides of the wearer's lower back and may be in a circle, elliptical or any other shape. The present invention can also be constructed so that the pad, instead of sewn onto the undergarment, is put into a pocket which secures it so that it is still able to function as an insulator. Furthermore, the pad is shaped such that it conforms to shape of the wearer's back, relieving the wearer of any discomfort. It may also be formed such that it will provide more insulation to those areas in more pain.

The total effectiveness of this invention is determined by theories of heat transfer, using the equations: $Q=U*A*\Delta T$ and $Q=(k*A*\Delta T)/L$ (where "Q" is the total heat transferred, "U" is the heat transfer coefficient of the interface, "A" is the heat transfer area, "ΔT" is the temperature difference between the body and the ambient air, "k" is the thermal-conductivity of the material, and "L" is the thickness of the material). Moreover, by using these equations, it can be determined which material is the most effective.

BRIEF DESCRIPTION OF THE DRAWINGS

The nature and advantages of this back insulating garment invention are more fully understood from the following description of preferred embodiments of the garment, illustrated by way of example in the accompanying drawings in which.

DETAILED DESCRIPTION OF THE PREFERRED EMBODIMENTS

Figure 1:
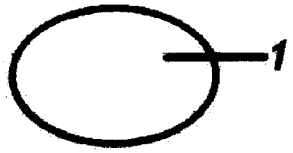
FIG. 1: is a front view of the insulation pad in an oval shape
Figure 2:
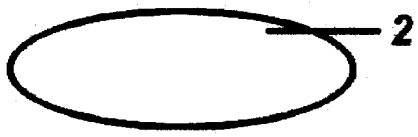
FIG. 2: is a front view of the insulation pad in an elliptical shape
Figure 3A:
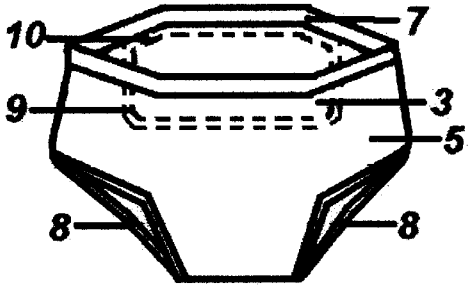
FIG. 3*a*: is a front view of the underwear briefs with a pocket to secure an oval insulation pad
Figure 3B:
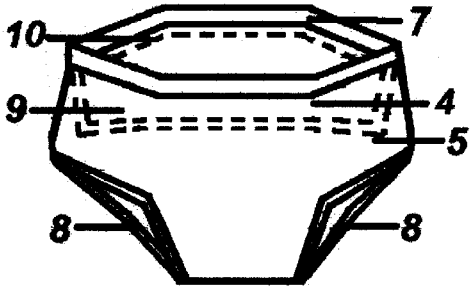
FIG. 3*b*: is a front view of the underwear briefs with a pocket to secure an elliptical insulation pad
Figure 4A:
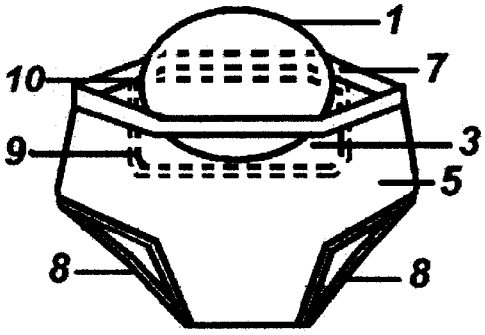
FIG. 4*a*: is a front view of the underwear briefs containing an oval insulation pad
Figure 4B:
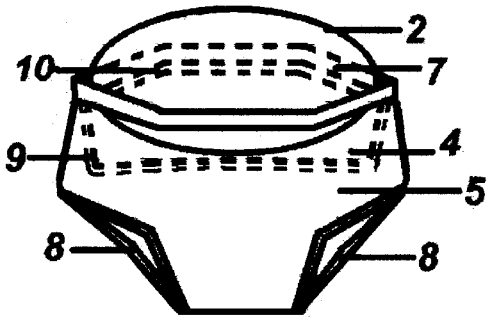
FIG. 4*b*: is a front view of the underwear briefs containing an elliptical insulation pad
Figure 5A:
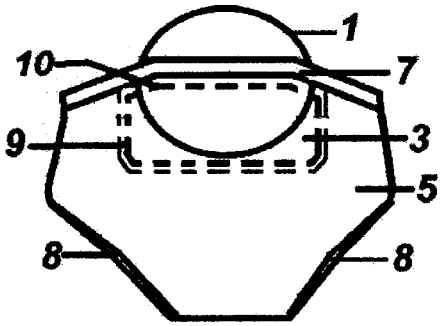
FIG. 5*a*: is a back view of the underwear briefs containing an oval insulation pad
Figure 5B:
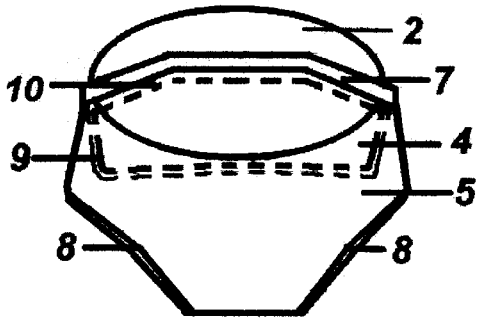
FIG. 5*b*: is a back view of the underwear briefs containing an elliptical insulation pad
Figure 6:
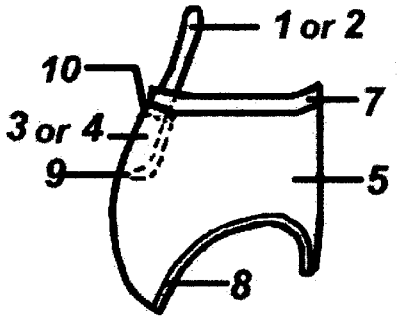
FIG. 6: is a side view of the oval or elliptical insulation pad in an underwear briefs
Figure 7A:
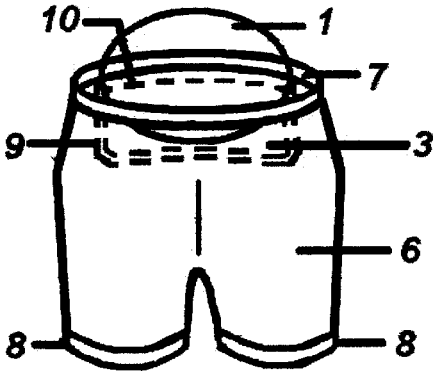
FIG. 7*a*: is a front view of the underwear boxers containing an oval insulation pad
Figure 7B:
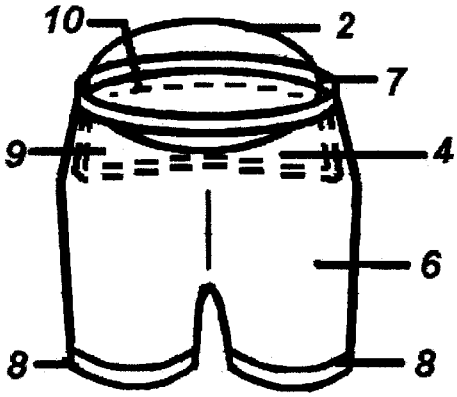
FIG. 7*b*: is a front view of the underwear boxers containing an elliptical insulation pad
Figure 8A:
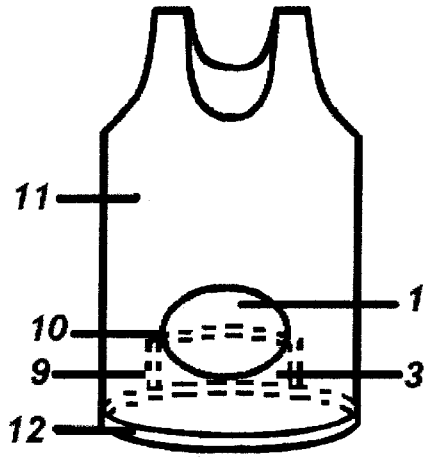
FIG. 8*a*: is a front view of the undershirt containing an oval insulation pad
Figure 8B:
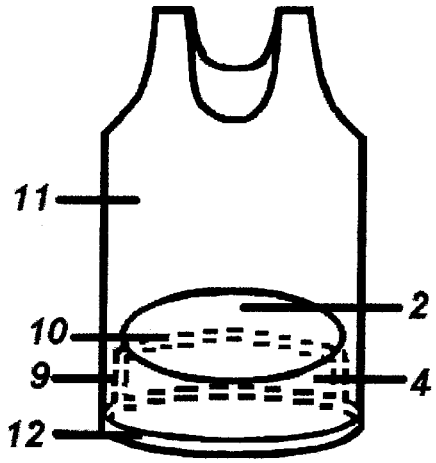
FIG. 8*b*: is a front view of the undershirt containing an elliptical insulation pad

A preferred embodiment of a lower back insulation undergarment, which is the subject of this invention, is illustrated in FIGS. 1–8.

An undergarment in the form of underwear briefs 5 or boxers 6 is provided having either an oval pocket 3 or an elliptical pocket 4 affixed to the back side of the undergarment for receiving an oval insulation pad 1 or an elliptical insulation pad 2, respectively. In accordance, the underwear briefs 5 or boxers 6 may be made of a blend of cotton, polyester, and/or lycra, but is not restricted to these. The inherent elasticity of this material facilitates maintaining of the undergarment in a stationary position so that the pockets and the insulation pads inserted therein, remain in the desired position. In addition to this, the briefs 5 or boxers 6 also includes elastic waist bands to further secure the desired position of the insulation pads. These elastic waist bands may be made of a blend of cotton, polyester, and/or lycra, but is not restricted to these. The elastic waist band 7 around the top of the undergarment helps keep the insulation pads snug against the wearer's back. This may have a width of approximately 0.75 inches to 1.5 inches, although not limited to these. There are also elastic waist bands 8 located at the lower end of the briefs 5 or boxers 6 terminating in proximity with the upper thighs of the wearer. These may have a width of approximately 0.2 inches to 1 inches, however not restricted to these. This additional lower support maintains the preferred position of the undergarment and its parts therein. The briefs 5 or boxers 6 and the parts therein may come in different sizes to accommodate the wearer's body size.

The pockets affixed to the underwear briefs 5 or boxers 6 come in two different shapes. The first is an oval pocket 3 to secure an oval insulation pad 1. Upon pulling these undershorts completely onto his body, the wearer feels the effects of the insulation pad 1 most in his lower back region. This oval pocket 3 has been designed to assure the oval insulation pad 1 therein is secured indefinitely. The double stitching 9 of the pocket supports the inserted pad, and so does the extra elastic band 10 located at the top of the oval pocket 3. This elastic band 10 stretches to allow insertion of the oval insulation pad 1 therein and then contracts, serving as a barrier to removal of the pad and to hold it in the proper position despite movements of the wearer. Thus, this leads to a minimal wobble of the pad over the lower back, increasing effect and comfort.

This oval pocket 3, in accordance with the undershorts itself, may come in different sizes to accommodate the wearer's body, further minimizing wobbleness. The pocket size for a small size is approximately 9 inches long and 4 inches high; for a medium size, it is approximately 11 inches long 5 inches high, and for a large size, the oval pocket 3 size is approximately 13 inches long and 6 inches high. The oval pockets 3 have dimensions slightly larger than the inserted insulation pads to maximize security and comfort. The material for the pocket is similar to that of the undershorts having elasticity while still comfortable.

The position of the oval pocket 3 in the underwear briefs 5 or boxers 6 is especially significant. The pocket must be positioned so that the upon insertion of the insulation pad, the entire lower back of the wearer is covered. As it can be noticed from the drawings, the position of the oval pocket is over the lower end of the lower back, and with the oval insulation pad 1 therein, the wearer's complete lower back is covered. Furthermore, the height at which various individuals wear undershorts varies, thus demanding a more flexible size of both the oval pocket 3 and the pad 1 therein. An extra inch on each side and on the bottom of the pocket and the subsequent larger insulation pad, permits the wearer to wear his undershorts as he normally would increasing comfort while his entire lower back is still receiving the insulation it needs.

In place of the oval pocket 3, an elliptical pocket 4 might be on the upper back part of the underwear briefs 5 or boxers 6. The elliptical pocket 4 is designed to contain an elliptical insulation pad 2 securely and comfortably. The elliptical insulation pad 2 (described in more detail later) not only insulates the lower back region as the oval insulation pad 1 does, but it also insulates the outer sides of the lower back region. Although not restricted to this, the pocket designed to hold the elliptical insulation pad 2, like the oval pocket 3, is also made of a blend of cotton, polyester, and/or lycra, It also contains the double stitch 9 around the edges and the extra elastic band 10 to further assure that the elliptical insulation pad 2 does not move even if the wearer does. Furthermore, in accordance with the size of the undershort, this elliptical pocket comes in different sizes to make it as comfortable and effective as possible for the wearer. The pocket size for a small underwear is approximately 13 inches long and 4 inches high; for a medium size, it is approximately 15 inches long and 5 inches high, and for a large size, approximately 17 inches long and 6 inches high.

Furthermore, these dimensions are slightly larger on each side because, as explained above, the height at which various individuals wear undershorts varies. Thus, regardless of how low or how high a person wears his undershorts, he will still find the insulation in the lower back and sides that he requires. The elliptical pocket 4 itself covers the lower end of the lower back and the lower end of the sides. Upon insertion of the elliptical insulation pad 2, the upper ends are also covered, thus insulating the entire lower back area including the sides.

The insulation pads may also come in two different shapes: for the oval pocket 3, an oval insulation pad 1, and for the elliptical pocket 4, an elliptical insulation pad 2. These insulation pads consist of a insulator and a cover cloth and are identical in every respect except for their shape and size. Their overall structures are similar. For reasons of extra comfort and effect, the pads may also be curved so they conform to the shape of the wearer's lower back.

The sizes of the insulation pads varies with the size of the pockets. For a small oval pocket 3, the oval insulation pad 1 is approximately 8 inches long and 6 inches high. For a medium, it is approximately 10 inches long and 7 inches high, and for a large, approximately 12 inches long and 8 inches high. For a small elliptical pocket 4, the elliptical insulation pad may be approximately 12 inches long and 6 inches high; for a medium it may be 14 inches long and 7 inches high; and for a large it may be 16 inches long and 8 inches high.

The oval insulation pad 1 covers primarily only the lower back region of the wearer. By doing so, it insulates that region, minimizing heat loss. According to medical research, this alleviates lower back pains by soothing the muscles and tendons in the lower back. It is also a preventive measure because it help keeps the wearer's lower back straight throughout the day.

The elliptical insulation pad 2 is specifically designed to encompass the entirety of the wearer's lower back and sides. If an individual suffers in both these regions, an elliptical insulation pad 2 would be ideal. This minimizes heat loss and soothes the lower back as well as sides; it also keeps the wearer's lower back relatively straight as he walks, sits, or bends over.

In addition to an underwear briefs 5 and boxers 6, the pockets and the insulation pads therein may be put in an undershirt 11. The undershirt may be a V-neck, round neck, or sleeveless. For the purpose of this invention, it would not make a difference which undershirt is used. Since the undershirt 11 has a tendency to move if the wearer does, an additional elastic band 12 was added to the bottom of the undershirt 11. This gives additional support and restricts movement of the undershirt 11, while at the same time, allows the wearer to move about freely. Also, similar to the undershorts, a pocket is sewn to the lower back end of the undershirt 11 so that upon insertion of the insulation pad, the lower back is covered. An oval pocket 3 and an oval insulation pad 1 may be used to cover primarily the lower back, and an elliptical pocket 4 and an elliptical insulation pad 2 may be used to cover the lower back as well as the sides. For further information on the pockets and insulation pads, read above.

The positioning of the pocket in an undershirt 11 is very significant. The pocket must be positioned so that it itself covers the lower end of the lower back. This may be difficult, since various individuals wear undershirts at different heights. Thus, the pocket and insulation pad therein must be made larger and more encompassing as they would normally be. As this undershirt 11 comes in different sizes to accommodate the wearer's upper body size the size of the pocket and insulation pad also have to be adjusted. In a small undershirt, the oval pocket 3 size is approximately 10 inches long and 5 inches high, and the elliptical pocket 4 size is approximately 14 inches long and 5 inches high. For a medium undershirt, the oval pocket 3 size is approximately 12 inches long and 6 inches high, and for the elliptical pocket 4 approximately 16 inches long and 6 inches high. For a large undershirt, the oval pocket 3 is approximately 14 inches long and 7 inches high, while for the elliptical pocket 4 it is approximately 18 inches long and 7 inches high.

The sizes of the insulation pads also alter a little. As each side of the pockets extended one extra inch, so will the insulation pads. Hence, for a small oval pocket 3, the oval insulation pad 1 is approximately 9 inches long and 7 inches high. For a medium, it would be approximately 11 inches long and 8 inches high, and for a large, approximately 13 inches long and 9 inches high. For a small elliptical pocket 4, the elliptical insulation pad is approximately 13 inches long and 7 inches high; for a medium it is 15 inches long and 8 inches high; and for a large it would be 17 inches long and 9 inches high.

DETAILED CALCULATIONS OF THE PREFERRED EMBODIMENTS

In the subsequent charts, I use these three materials for comparison (although the insulation pad may extend to other materials also): polystyrene foam, cotton, and silk. Each material has a different insulation, comfort, and obtrusiveness, and all of these factors will take play in determining which material is the best for an insulation pad.

Figure 9:
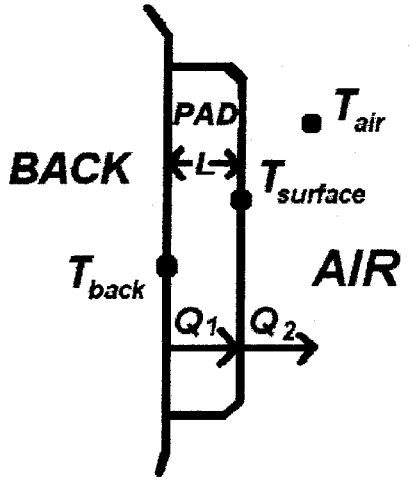
FIG. 9: is a side view of a diagram showing different 'T' (temperature values used in the calculations

To determine the overall effectiveness of these materials, the following equations may be used to achieve quantitative results:

$$Q=U*A*(T_{body}-T_{air})$$

and at equilibrium $$Q=[k*A*(T_{body}-T_{surface})]/L=U*A*(T_{surface}-T_{air})$$

where 'Q' is the heat loss from the body in 'Btu/hr', 'U' is the overall heat transfer coefficient of the interface in 'Btu/(degree F*sq. ft*hr) and 'A' is the heat transfer area of the specimen being observed in 'sq ft.'. '$T_{body}$' is the temperature of the human body, '$T_{air}$' is the temperature of the atmosphere, and '$T_{surface}$' is the temperature of the outer surface of the insulation pad (FIG. 9), 'k' is the thermal conductivity constant for the insulation material used in 'Btu/hr*sq ft.*degree F/ft', and 'L' is the thickness of the insulation pad. In the following pages, using these equations and the distinct characteristics of each material, a comparison is made among these materials: cotton, polystyrene foam, and silk.

Note: (for simplicity, all calculations will involve the small oval insulation pad (8 in×6 in) for which the area is equal to: 0.28 $ft^2$, and the thickness of the materials will remain at 1 in):

For natural convection heat loss from the body, it is assumed that back of a person behaves as a vertical plate. The overall heat transfer coefficient for such a loss is given in Btu/(degree F*sq. ft*hr). To determine the natural convection heat loss from the body, we can use this equation:

$$Q=U*A*(T_{body}-T_{air})$$

for which 'U' for the body is equal to: $0.29\ [(T_{body}-T_{air})/L]^{1/4}$

Example: in cold weather: $U=0.29\ [(98.4°\ F.-0°\ F.)/0.5\ ft]^{1/4}=1.086$ Btu/(degree F*sq. ft*hr)

$$Q=1.086*0.28*(98.4-0)=29.89$$

| conditions | U in Btu/(° F.*sq. ft*hr) | Q (heat loss from body) in Btu/hr |
|---|---|---|
| cold weather (0 F.) | 1.086 | 29.89 |
| cool weather (45 F.) | .9323 | 13.94 |
| hot weather (90 F.) | .5871 | 1.381 |

To calculate the heat loss of body to the insulation pad, we use this equation:

$$Q=[k*A*(T_{body}-T_{suface})]/L=U*A*(T_{suface}-T_{air})$$

Example for cotton in cold weather: $Q=[0.0335*0.28*(98.4-T_{surface})/0.083=1.086*0.28*(T_{surface}-0)$ Calculating first for $T_{surface}$: $[0.0335*0.28*(98.4-T_{surface})/0.083=1.086*0.28*(T_{surface}-0)$ $$T_{surface}=26.6\ F$$

Now, we use this equation to determine the heat insulated: $Q=[k*A*(T_{body}-T_{surface})]/L$ $$Q=[0.0335*0.28*(98.4-26.6)]/0.083=8.082$$

| | k in Btu/hr*sq ft.* | $T_{surface}$ in ° F. | | | Q (heat loss from body) in Btu/hr | | |
|---|---|---|---|---|---|---|---|
| material | ° F./ft | cold | cool | hot | cold | cool | hot |
| cotton | .0335 | 26.6 | 61.1 | 93.4 | 8.08 | 4.20 | 0.562 |
| silk | .030 | 24.5 | 59.9 | 93.2 | 7.45 | 3.88 | 0.526 |
| poly-styrene foam | .0020 | 2.13 | 46.3 | 90.3 | 0.647 | 0.350 | 0.0555 |

Figure 10:
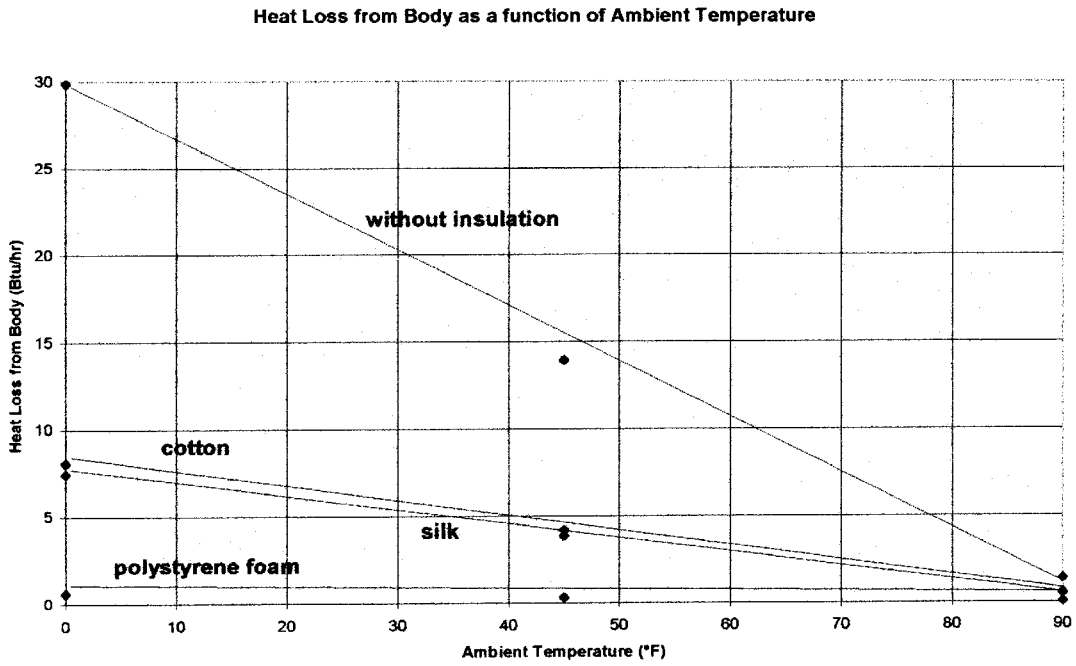
FIG. 10: is a graph of heat loss from body as a function of ambient temperature

In the graph labeled "Heat Loss from Body as a function of Ambient Temperature" (FIG. 10), it is observed that without any insulation the heat loss from the body is low for a very high temperature, but increases dramatically as the air temperature decreases (large slope). At 0° F., the heat loss is near 30 Btu/hr. With an insulation pad made of cotton, the heat loss from the body is also low for a very high ambient temperature; however, as the ambient temperature decreases, the heat loss from the body is much less than it is without any insulation (smaller slope). Silk is observed to have approximately the same insulation effects as cotton. However, polystyrene foam, is observed to have the most effective insulation. The slope of this line is close to zero; with polystyrene foam, the heat loss from the body is almost the same at 0° F. as it is at 90° F.

Using a small oval insulation pad 1, the area of the body that is being covered is 0.28 $ft^2$. Plus, we assume that the body being insulated is approximately 0.5 inches deep. Thus the volume of the body that is being insulated is 0.0117 $ft^3$. To achieve the mass, we multiply the volume by the density of the body, which is assumed to be a little higher than that of water (62 $lb/ft^3$) at 70 $lb/ft^3$. Thus, the mass of body being insulated is approximately 0.817 lbs. Also, we assume the specific heat of the body is the same as that of water, which is 1.0 Btu/(lbs*° F.).

To determine the temperature of the body after heat loss, we can use this equation: $Q=m*c*(T_{initial}-T_{final})$, where 'Q' is heat loss from body in 'Btu/hr', 'm' is the mass of the body being insulated in 'lbs', 'c' is the specific heat of the body in 'Btu/(lbs*° F.)', and '$T_{initial}$' is the original temperature of the body in '° F.', and '$T_{final}$' is the temperature after heat loss in '° F.'.

Example: for cotton in cold conditions:

$$Q = m*c*(T_{initial} - T_{final})$$
$$8.8 = .817 * 1.0 * (98.4 - T_{final})$$
$$T_{final} = 88.51$$

| | Temperature after heat loss in ° F. | | |
|---|---|---|---|
| material | cold | cool | hot |
| none | 61.8 | 81.3 | 96.7 |
| cotton | 88.51 | 93.3 | 97.7 |
| silk | 89.3 | 93.7 | 97.8 |
| polystyrene foam | 97.6 | 98.0 | 98.3 |

Figure 11:
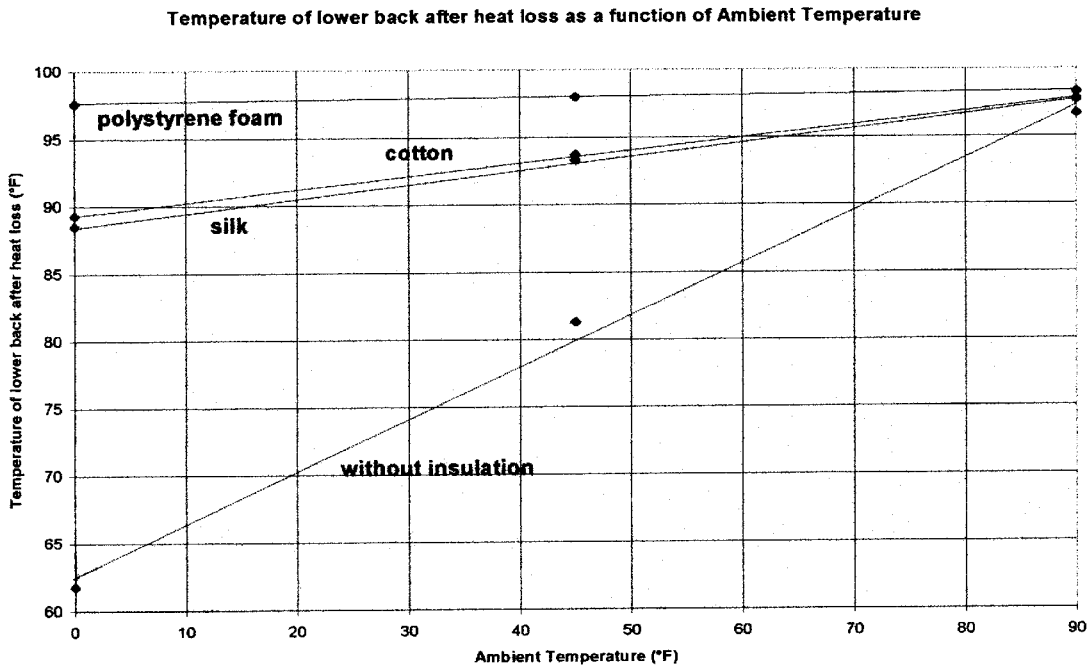
FIG. 11: is a graph indicating the temperature of lower back after heat losses as a function of ambient temperature.

In the graph labeled "Temperature of lower back after heat loss as a function of Ambient Temperature" (FIG. 11), it is observed that without any insulation the temperature of the lower back after heat loss is high for a very high ambient temperature, but it decreases rapidly as the air temperature decreases (large slope). At 0° F., the temperature of the back after heat loss is near 62° F. With an insulation pad made of cotton, the temperature of the back after heat loss is also high for a very high ambient temperature; however, as the ambient temperature decreases, the final temperature of the body is much greater than it is without any insulation (smaller slope). Silk is observed to have approximately the effects as cotton. However, polystyrene foam, is observed to have the most effective insulation. The slope of this line is close to zero, with polystyrene foam, the temperature of the lower back after heat loss is almost the same at 0° F. as it is at 90° F.

GRAPHS:

Graph 1:

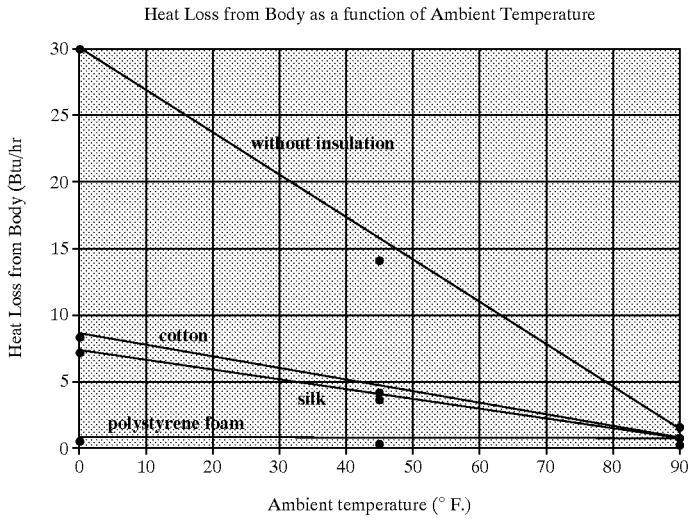

Graph 2:

Temperature of lower back after heat loss as a function of Ambient Temperature

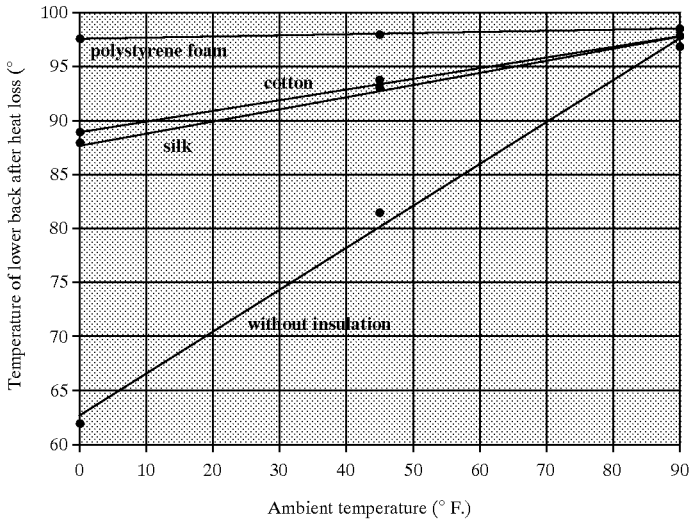

I claim:

1. An undergarment for insulating lower backs for a human being comprising:

a torso covering undergarment having a body portion with a pocket of predetermined cloth material, of predetermined cross-sectional shape of sufficient size to accommodate a pad and having an upper edge;

a pad being of predetermined insulation material of predetermined cross-sectional shape and of sufficient size to insulate a human being's lower back;

said pad positioned on an inside, posterior end of said undergarment in said pocket;

and wherein a lower end of said pad is secured within said pocket and with an upper opposite end of the pad extending beyond said undergarment pocket upper edge to insulate the lower back.

2. The undergarment of claim 1 wherein said pad is made of polystyrene foam.

3. The undergarment of claim 2 wherein said pad of polystyrene foam is one inch thick.

4. The undergarment of claim 3 wherein said pad of one inch thick polystyrene foam is elliptical in shape.

5. The undergarmnent of claim 1 wherein said pocket is semi-elliptical in shape.

6. The undergarmnent of claim 5 wherein said semi-elliptical pocket has double stitching along the ends thereof for creating extra durability.

7. The undergarment of claim 5 wherein said semi-elliptical pocket has elastic band on an upper portion thereof for creating extra support of said pad.

8. The undergarment of claim 1 wherein said pad is contained within a cloth covering for easy cleaning and extra durability.

* * * * *